United States Patent [19]

Cone

[11] 4,251,019

[45] Feb. 17, 1981

[54] POTABLE CONTAINER HAVING SANITIZED STRAW

[76] Inventor: Robert R. Cone, 16420 N.E. 30th Ave., N. Miami Beach, Fla. 33160

[21] Appl. No.: 48,151

[22] Filed: Jun. 13, 1979

[51] Int. Cl.[3] ..... B65D 83/00; A47G 19/22

[52] U.S. Cl. ..... 229/7 S; 222/523; 220/90.2; 215/1 A

[58] Field of Search ..... 229/7 S; 215/1 A, 1 S, 215/229; 239/33; 220/90.4; 222/523, 525, 527, 529, 522

[56] References Cited

U.S. PATENT DOCUMENTS

| | | | |
|---|---|---|---|
| 2,392,479 | 1/1946 | Humbert | 229/7 S |
| 2,805,809 | 9/1957 | Pugh | 229/7 S |
| 2,838,220 | 6/1958 | Oppenheimer | 229/7 S |
| 3,362,607 | 1/1968 | Weitzner | 229/7 S |
| 3,406,868 | 10/1968 | Rogers | 220/90.2 |
| 3,486,679 | 12/1969 | Pfahler | 229/7 S |
| 3,542,278 | 11/1970 | Deaver | 229/7 S |
| 3,774,804 | 11/1973 | Henning | 229/7 S |

*Primary Examiner*—Davis T. Moorhead
*Attorney, Agent, or Firm*—Jack E. Dominik

[57] ABSTRACT

A potable container having a sanitized straw therein. The container has a panel that partitions the container cavity into a potable-receiving major cavity and a non-potable receiving minor cavity having the upper portion of a straw therein.

A pull tab is provided that when opened exposes the straw containing minor cavity only so that the potable containing major cavity is not opened. A straw sealing member depends from the pull tab so that when the tab is closed, the straw is capped thereby preventing the potable from entering the minor cavity.

The lower portion of the straw is horizontally disposed in the major cavity. The straw has a bellows-like middle portion providing bending and stretching means. A monofilament member aids in opening a wrapper for the sanitized straw when the tab is opened and also serves to retain the tab in a closed position.

10 Claims, 6 Drawing Figures

POTABLE CONTAINER HAVING SANITIZED STRAW

BACKGROUND OF THE INVENTION

1. Field of the Invention

This invention relates generally to potable containers having straws contained therein and more particularly relates to such a container having a sanitized straw therein and further having a means whereby such container may be resealed and stored in any position without spillage of the potable.

2. Description of the Prior Art

Potable containers having interior straws are known. The earlier containers, however, are not sanitary because the entire straw is immersed within the potable. Nor can the earlier containers be effectively resealed.

There is a need for a container having a straw that is protected by a sanitary wrapper prior to use by the consumer of the potable. After the straw has been unwrapped, there should exist means for causing the straw to project upwardly so that the same may be engaged for drinking purposes. Means are needed for permitting resealing of each container after use, and such means should prevent leakage of the potable.

SUMMARY OF THE INVENTION

The need for such a potable container has not been fulfilled by the earlier known containers. The long standing and heretofore unresolved limitations of the earlier devices are overcome by a potable container having two inner compartments. The larger of the two compartments is a potable-containing cavity while the smaller of the two compartments is a straw-receiving cavity. The two compartments are separated by a liquid impervious panel which has an opening formed at its lowermost portion for admission of a straw. The straw has a flexible middle portion so that its lower portion may lie on the bottom of the container and be in fluid communication with the potable while its upper portion is angled relative thereto so that the straw projects upwardly to the top of the container. A fluid-tight seal is provided at the point of passage of the straw through the panel so that the potable cannot leak into the straw-containing cavity from the potable cavity through the straw-receiving aperture formed in the panel.

A hingedly-mounted pull tab formed in the upper wall of the container opens the straw-containing cavity but not the potable-containing cavity. Depending from the pull tab is a plug which caps the uppermost end of the straw when the pull tab is closed. Means are provided for opening a sanitized paper wrapper which protects the straw and such means further serves to retain the pull tab in its closed configuration when desired.

It is therefore seen to be an object of the invention to provide a potable container having a sanitized straw interiorly thereof and projectable therefrom.

It is a closely related object of the invention to provide a container having two compartments so that the portion of the straw exposed to the user of the invention is not in contact with the potable.

Still another closely related object of the invention is to provide a container having two compartments so that the compartment containing the potable need never be opened thereby aiding the resealability of the container.

Still another closely related object of the invention is to provide a means whereby capping the straw in the compartment having no potable therein prevents potable from the other compartment from entering into said straw containing compartment.

Another related object of the invention is to provide means for freeing the sanitized straw from its wrapper when the pull tab exposing said straw is pulled.

Still another object of the invention is to provide means for retracting such straw into the container when the pull tab is closed.

BRIEF DESCRIPTION OF THE DRAWINGS

Further objects and advantages of the present invention will become apparent as the following description proceeds, taken in conjunction with the accompanying drawings in which.

DESCRIPTION OF THE PREFERRED EMBODIMENT

Figure 1:
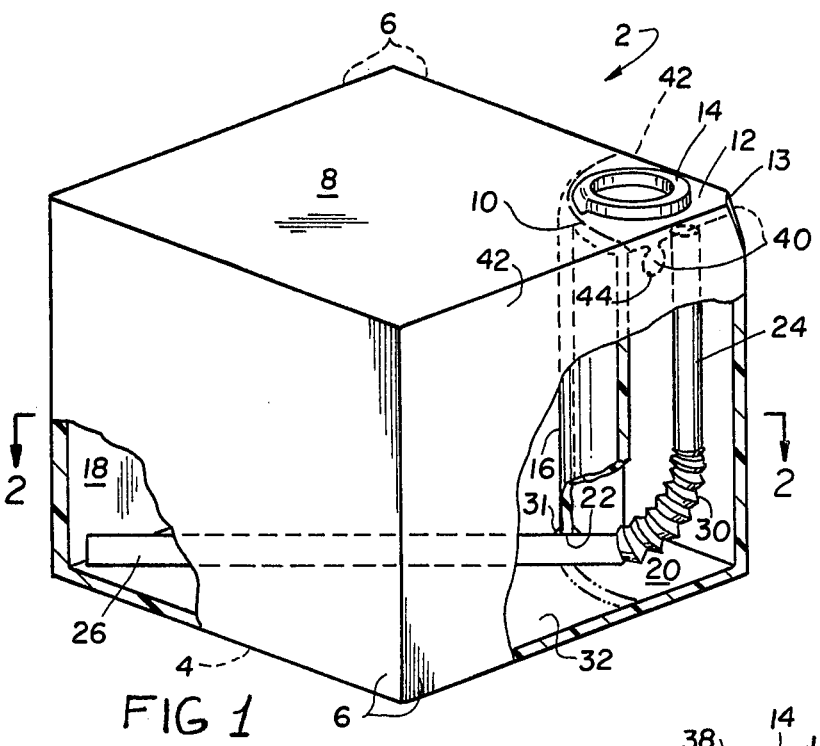
FIG. 1 is a perspective view of the preferred embodiment of the invention, partially broken away to show details.
Figure 4A:
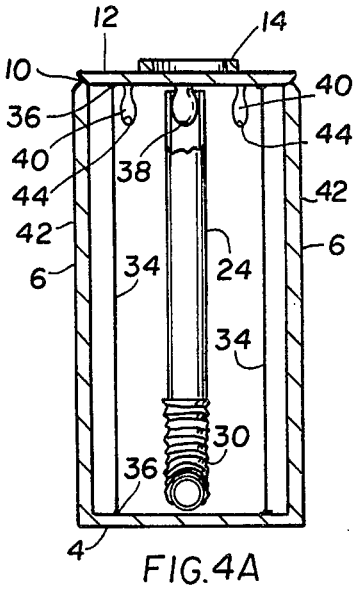
FIGS. 4(*a*), 4(*b*) and 4(*c*) are cross-sectional views taken along line 4—4 of FIG. 2, showing the resealed container, paper enclosed straw and opening action of monofilaments on paper. Locking tabs 40 and seats 44 have been shown in FIG. 4(*a*) only for simplicity purposes.
Figure 2:
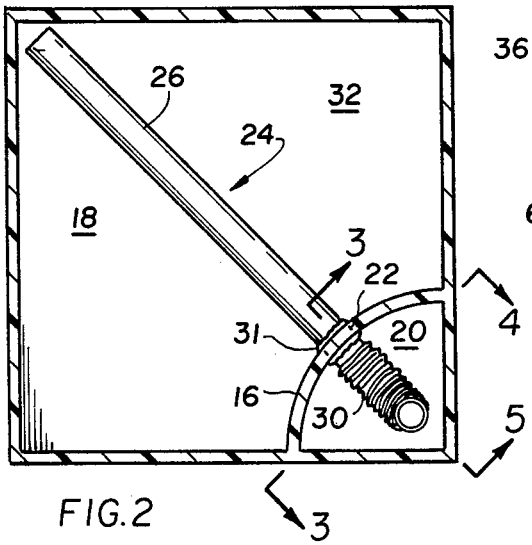
FIG. 2 is a cross-sectional view taken along line 2—2 of FIG. 1.
Figure 4B:
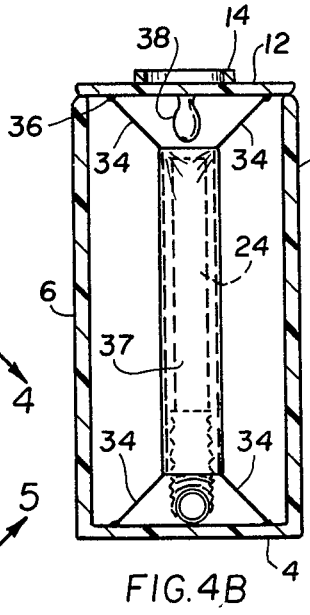
Figure 4C:
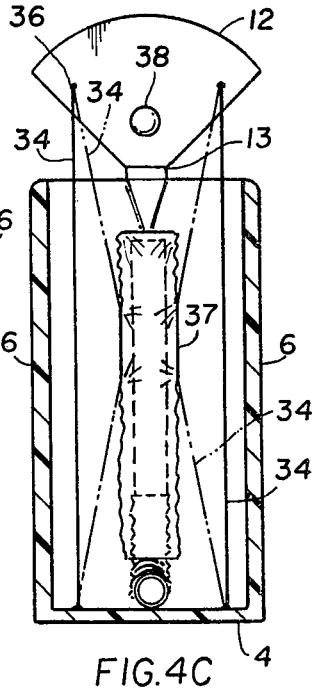
Figure 3:
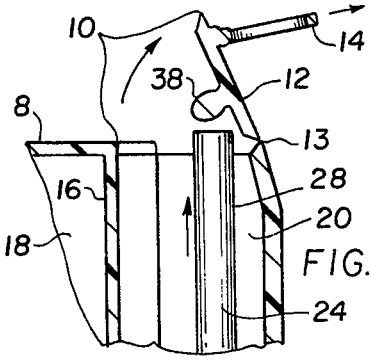
FIG. 3 is a cross-sectional view taken along line 3—3 of FIG. 2.

A cubicle potable container, generally designated 2, is shown in FIG. 1 and has a bottom wall 4, side walls 6 mounted about the periphery thereof and projecting upwardly therefrom and a top wall 8.

A weakening line 10 is formed in the top wall to define a pull tab or lid 12 having a pull tab ring 14 attached thereto. The preferred weakening line 10 is arcuate in form.

A panel 16 is shown which divides the cavity of the cubicle container 2 into a potable receiving major cavity 18 and a straw-receiving minor cavity 20. The panel 16 is arcuate in section, and corresponds in size and shape with the weakening line 10 so that when pull tab ring 14 is pivoted about hinge means 13 thereby separating pull tab 12 at the weakening line 10 from top wall 8, only the minor cavity 20 is thereby exposed.

A straw-receiving aperture 22 is formed at the lowermost end of panel 16. A straw 24 passes through said aperture 22, so that the straw top portion 28 is disposed in the minor cavity 20 and the straw bottom portion 26 is disposed in the major cavity 18. The straw 24 has a flexible bellows-like middle portion 30 which allows it to bend without unduly constricting the straw middle portion 30 so that potable may flow through the straw 24 easily.

A wax or other suitable seal 31 is applied at the juncture of the straw-receiving aperture 22 and the straw 24 to assure that potable in the major cavity 18 cannot leak into the minor cavity 20.

The lower portion of the straw 26 is preferably attached along its longitudinal length to the inner face 32 of the bottom wall 4. The lower portion 26 terminates in drainage corner 33 so that the entire contents of the major cavity 18 can be imbibed by the user of the invention by simply lowering said drainage corner 33 relative to the remaining elements of the invention.

A depending straw plug 38 is integrally formed on the lower surface of the pull tab 12 and is disposed centrally thereof. Preferably, the straw plug 38 is of bulbous shape so that it may engage the uppermost end of the straw 24 and plug the same when the pull tab 12 is closed. If the user of the invention desires to save a portion of the potable for consumption at a subsequent time, date, the pull tab 12 is rotated about hinge means 13 until the depending straw plug 38 formed on the lower surface of the pull tab 12 engages and enters into the uppermost end of the straw 24, thereby capping the same. The pluging of the straw 24 will be complete when the pull tab 12 is returned to its original position. Since the only path available to the potable in the major cavity 18 for escaping therefrom is through the straw 24, the plug 38, when seated within the straw 24, prevents spillage of the potable regardless of the position at which the container 2 is stored.

To further insure that the pull tab 12 will not reopen while the container 2 is in storage, further means may be provided for insuring that the straw plug 38 remains seated within the straw 24.

A pair of depending locking members 40 may be provided on the opposed edges of the pull tab 12. These locking members are configured and dimensioned to fit within recesses 44 formed in the reinforced upper edges of side walls 42. The depending locking members 40 are preferably of deformable material and of bulbous configuration. The recesses are also of bulbous configuration, and receive the depending locking members therein in snap fitting engagement.

Additional means comprising a pair of monofilament members 34 may be provided to further insure that the pull tab 12 will remain closed when the container 2 is in storage. Each end of the monofilament members 34 is heat treated to form monofilament butts 36. Each monofilament member 34 has one end attached to the bottom wall 4, and the other end attached to the pull tab 12 at the periphery thereof. In this manner, when the pull tab 12 is opened, the monofilament member 34 will stretch, permitting such opening. However, when the pull tab 12 is closed, the monofilament members 34 will exert a tensive force opposing accidental reopening of the pull tab 12. Nylon threads are suitable monofilament members. Woven members are contraindicated because the same tend to stick to the straw 24.

The monofilament members 34 also serve another function in addition to that of holding the pull tab 12 in the closed position. Since the preferred embodiment of the invention contemplates a sanitized straw 24, a sanitary paper wrapper 37 is placed around the straw 24 prior to shipment of the container to the consumer. The wrapper 37 is placed not only around the straw 24 but also around the monofilament members 34 so that when the pull tab 12 is opened, the monofilament members 34 will move away from the straw 24 and tear open the wrapper 37 thereby exposing the straw 24.

When the pull tab 12 is opened, the straw plug 38 will disengage from the straw 24, and the flexible bellows-like middle portion 30 of the straw 24 will urge the straw 24 to project upwardly so that the consumer may begin partaking of the potable. When the pull tab 12 is closed, and the straw plug 38 reenters the straw 24, thereby driving the same downwardly, the bellows-like middle portion 30 of the straw 24 will allow the straw to retract into the minor cavity. Although the preferred embodiment of the invention is cubicle, it is clear that the container could take virtually any shape. Another commercial embodiment of the invention contemplates a container of Cracker-Jack (trademark) box-type configuration, i.e., a box having a thickness of approximately $\frac{1}{2}$ its width and a width of approximately $\frac{1}{2}$ its height.

Although particular embodiments of the invention have been shown and described in full here, there is no intention to thereby limit the invention to the details of such embodiments. On the contrary, the intention is to cover all modifications, alternatives, embodiments, usages and equivalents of the subject invention as fall within the spirit and scope of the invention, specification and the appended claims.

What is claimed is:

1. A potable container, comprising, a closure body having a top wall, a bottom wall and side walls, a panel member for partitioning said closure body into two cavities, said cavities comprising a permanently sealed major potable-receiving cavity and a minor non-potable receiving cavity having resealable lid means, a drinking straw having its lower end disposed in said major cavity and its upper end disposed in said minor cavity, said panel member having an aperture for receiving said straw therethrough, means for providing a fluid-tight seal around said straw at said aperture, said resealable lid means having means for capping the upper end of said straw when said minor cavity is sealed, whereby potable permanently sealed in said major cavity may escape therefrom only through said straw so that capping said straw by sealing said minor cavity prevents spillage of the potable from the container regardless of the storage position of the container.

2. The potable container of claim 1, said resealable capping means comprising a straw plug member depending from the underside of said resealable lid means.

3. The potable container of claim 2, said straw capping means further comprising a bulbous straw plug member integrally formed with the underside of the resealable lid means and substantially centrally disposed thereon.

4. The potable container of claim 3, said resealable lid means further comprising, a lid portion formed in said top wall and defined by weakening lines thereon, said lid portion hingedly attached so that separating said lid portion from the balance of said top wall by rupturing said weakening lines permits said lid portion to rotate about said hinge, said lid portion further having opposed depending deformable side wall engaging members formed on the periphery of said lid portion, said side walls having reinforced recessed portions adjacent said lid portion adapted to receive in snap-fitting engagement a corresponding depending side wall engaging member so that closing of said lid member not only caps said straw but also effects the momentary deformation of said depending side wall engaging members while the same are entering into snap-fitting engagment with said side wall recesses thereby providing a secure closure of said lid means.

5. The potable container of claim 4, further comprising means for maintaining said drinking straw in a sanitized condition prior to use of said straw by the consumer of said potable.

6. The potable container of claim 5, said sanitizing means comprising, germ-impervious means wrapped about the upper portion of said straw, at least one monofilament means adjacent said upper portion of said straw and encased within said germ-impervious means with said straw, said monofilament means having one of its ends fixedly secured to said container bottom wall and its other end fixedly secured to said hingedly attached resealable lid so that opening of said lid causes said monofilament means to move outwardly relative to said straw, said germ-impervious means formed of material capable of being torn by said monofilament means so that said outward travel of said monofilament means when said lid is opened causes said germ-impervious means to be torn so that the upper portion of said straw is exposed when the consumer of the potable opens the resealable lid.

7. The potable container of claim 6, said monofilament means comprised of a stretchable material so that the monofilament means exerts a tensive force on said resealable lid when said lid is closed, the length of said monofilament member proportioned so that such member is not stretched beyond its elastic limit when said resealable lid is fully opened.

8. The potable container of claim 7, said drinking straw further having an expandable and compressable bellows-like mid portion, said straw positioned within said minor cavity so that when said resealable lid is closed, said mid portion of said straw is compressed and when said lid is opened, said mid portion is expanded thereby causing the straw to protrude upwardly from said minor cavity so that the consumer of the potable may engage the same for drinking purposes.

9. The potable container of claim 8, the lower portion of said straw fixedly secured along its length to the inner face of the bottom wall of said major cavity, the upper portion of said straw angled upwardly relative to said lower portion so that the upper portion of the straw is in substantially upstanding configuration within said minor cavity, said bellows-like mid portion of the straw permitting the angled relationship of the ~~upper~~ and lower portions of the straw without unduly restricting the flow of potable through said straw, whereby said middle portion serves the dual function of urging the upper portion of the straw upwardly when said resealable lid is opened and providing bending means to accomodate the relative orientation between the upper and lower portions of said straw.

10. The potable container of claim 9, further comprising, said container having a cubicle configuration for providing an optimal transportation and storage configuration, said partitioning panel disposed in a corner of said cubicle container and having a cross-section corresponding to the configuration of the weakening line formed in the said container top wall, the lower portion of said straw terminating in the corner of said cubicle container opposing said partitioning panel, whereby said lower portion of said straw is diagonally disposed on the inner face of said container bottom wall and emptying said major cavity is achieved by the consumer of the potable by lowering the corner opposing the minor cavity.

* * * * *